United States Patent [19]

Payne

[11] Patent Number: 4,612,478

[45] Date of Patent: Sep. 16, 1986

[54] DIMMER CIRCUIT FOR HIGH INTENSITY DISCHARGE LAMP

[76] Inventor: Stephen C. Payne, 2571 Roanoke Ave., New Albany, Ind. 47150

[21] Appl. No.: 683,762

[22] Filed: Dec. 19, 1984

[51] Int. Cl.[4] ..... H05B 37/00

[52] U.S. Cl. ..... 315/176; 315/170; 315/173; 315/194; 315/244; 315/DIG. 4; 315/DIG. 5

[58] Field of Search ..... 315/DIG. 4, DIG. 5, 315/244, 194, 170, 176 X

[56] References Cited

U.S. PATENT DOCUMENTS

| | | | |
|---|---|---|---|
| 2,975,331 | 3/1961 | Diaz et al. | 315/176 |
| 3,309,567 | 3/1967 | Flieder et al. | 315/176 |
| 3,323,015 | 5/1967 | Everest | 315/173 |
| 4,362,971 | 12/1982 | Sloan | 315/244 |
| 4,376,911 | 3/1983 | Kaneda et al. | 315/176 |
| 4,410,837 | 10/1983 | Suzuki et al. | 315/170 |

*Primary Examiner*—Harold Dixon

*Attorney, Agent, or Firm*—Sprung Horn Kramer & Woods

[57] ABSTRACT

A lamp dimmer circuit for a high intensity discharge lamp includes an auto transformer, a power factor correction capacitor, a reactor ballast, a solid state phase control current module, a dimming control, a high frequency power supply, a coupling transformer, a high frequency by pass capacitor and a lamp. The high frequency low current source formed by the high frequency by pass capacitor, coupling transformer and high frequency power supply act to maintain the lamp arc even with variations in line voltage.

1 Claim, 3 Drawing Figures

DIMMER CIRCUIT FOR HIGH INTENSITY DISCHARGE LAMP

BACKGROUND OF THE INVENTION

The present invention relates to a dimming circuit for a high intensity discharge (HID) lamp. Circuits for dimming an HID lamp are known in the art.

One conventional circuit is shown in FIG. 1 and consists of an autotransformer, a power factor correction capacitor 2, a reactor ballast 3, a solid state phase control circuit module 4, a dimming control 5 and a lamp 6.

In the prior art circuit shown, the autotransformer converts the line voltage to the appropriate voltage to allow the reactor to act as a voltage limited current source for the lamp. The dimming control adjusts the phase angle of the current through the control module which controls the current to the lamp.

The disadvantage of this type of control is that at lower than normal current levels, depending upon the characteristics of the particular lamp, the arc in the lamp becomes highly unstable and extinguishes. Limited lamp dimming results with attendant susceptibility to variations in line voltage, ballast production tolerances and lamp tolerances.

The object of the present invention is to overcome the disadvantages of such conventional circuits.

SUMMARY OF THE INVENTION

These and other objects and advantages of the present invention are achieved in accordance with the present invention by a circuit consisting of an autotransformer, a power factor correction capacitor, a reactor ballast, a solid state phase control current module, a dimming control, a high frequency capacitor and a lamp. With the addition of a high frequency low current source to maintain the lamp arc and a coupling transformer, a maximum range dimming control is provided with no dependence on line or lamp characteristics.

The present invention will be described in more detail with reference to the accompanying drawings, wherein:

DETAILED DESCRIPTION OF THE PREFERRED EMBODIMENTS

Figure 1:
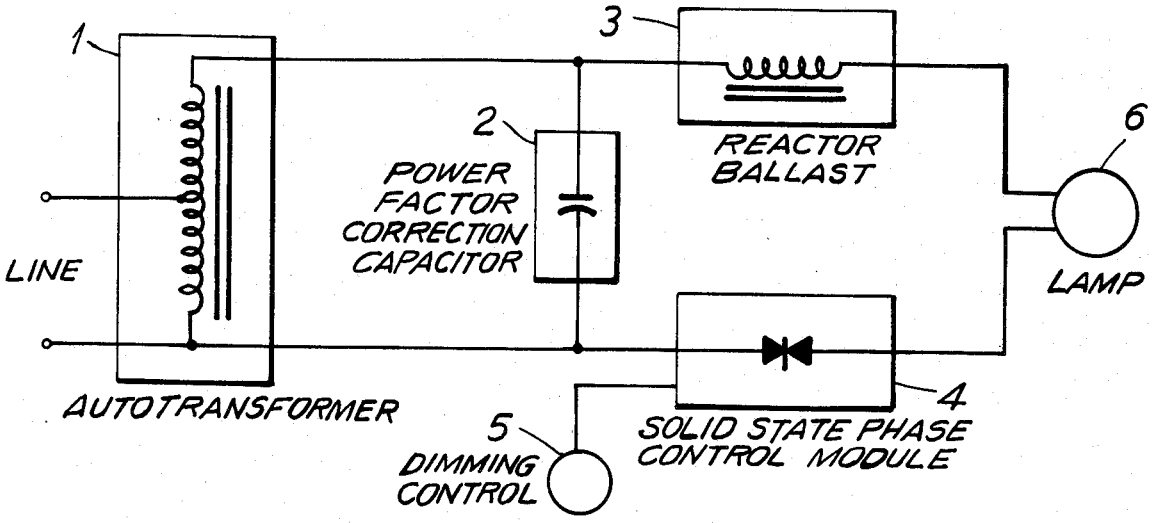
FIG. 1 (PRIOR ART)
FIG. 1 is a schematic of a prior art circuit.
Figure 3:
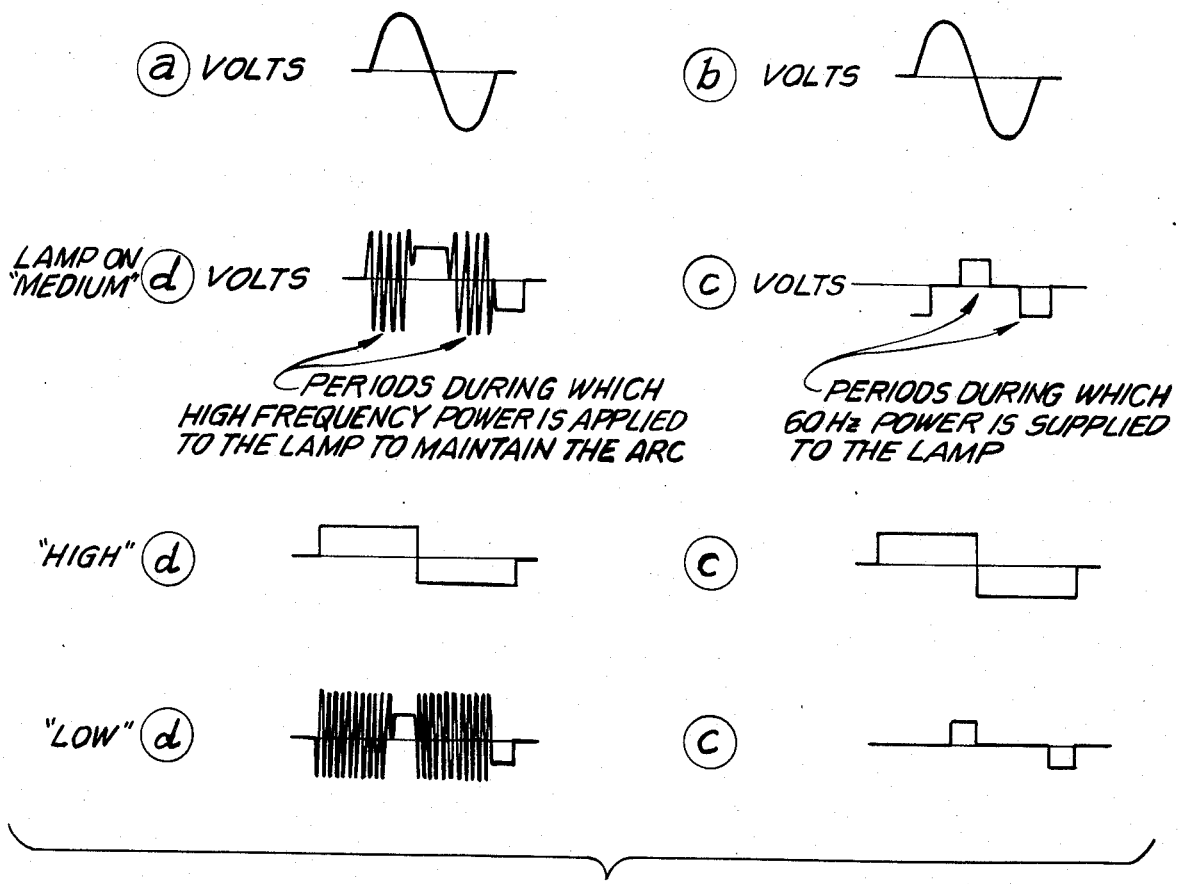
FIG. 3 shows the waveforms at different points in the circuit of FIG. 2.
Figure 2:
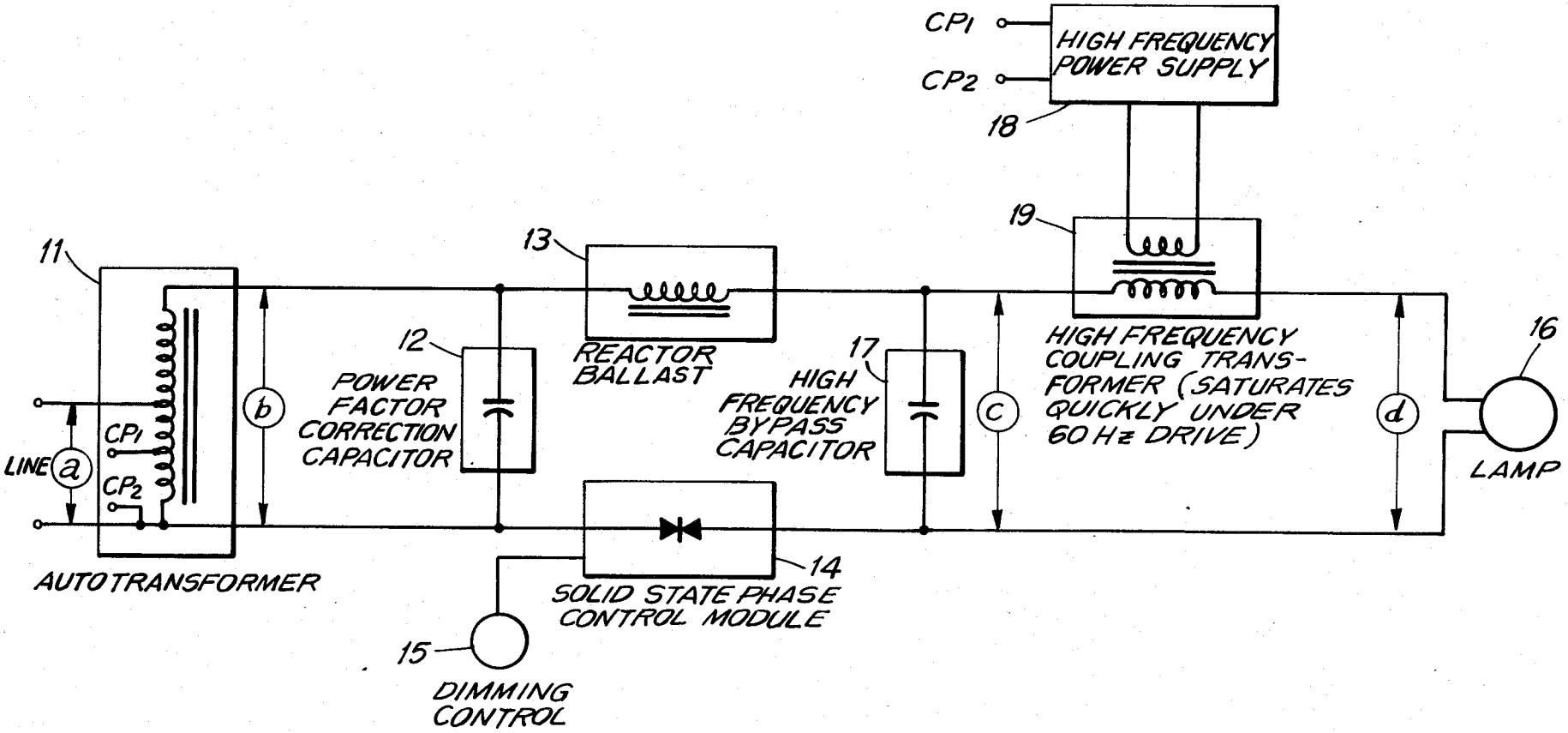
FIG. 2 is a schematic of the dimming circuit according to the present invention.

Referring now to FIGS. 2 and 3, the HID lamp dimming circuit in accordance with the present invention includes an autotransformer 11, a power factor correction capacitor 12, a reactor ballast 13, a solid state phase control module 14, a dimming control 15, a lamp 16, a high frequency bypass capacitor 17, a high frequency power supply 18 and a high frequency coupling transformer 19. The high frequency supply, bypass capacitor and coupling transformer are used to maintain the arc lamp.

In operation, the autotransformer 11 converts line voltage to a voltage that would allow the lamp 16 to operate within the voltage/current characteristics described by AINSI for the given lamp/reactor combination. This usually is about twice the lamp operating voltage. For a 250 watt metal halide lamp (with operation voltage equal to 135 volts) the auto transformer voltage should be 240 to 325 volts a.c. at 60 Hz.

The reactor ballast 13 limits the current to the lamp 16 to the operating value. In the above case this would be about 2 amps.

The phase control module 14 and dimming control 15 operate in principal similarly to a standard incandescent dimmer control allowing a partial or phase control voltage to be applied to the reactor and lamp combination.

The high frequency power supply 18 provides a constant current high frequency signal to the lamp 16 through the coupling transformer 19 and the bypass capacitor 17. When the dimmer cuts the phase angle of the autotransformer voltage back to a level no longer able to maintain the arc in the lamp, the lamp arc voltage rises quickly to a level beyond that for the autotransformer. At this point the autotransformer is no longer suppling power to the lamp. A much lower power is being supplied by the high frequency supply at a high voltage, typically 500 to 1200 volts, and low current, 0.01 to 0.05 amps. The lamp arc remains established on each half cycle and full range dimming is accomplished.

FIG. 3 shows the voltage at different points a–d in the circuit of FIG. 2. The drawings show the waveforms at off, low, medium and full on conditions.

It will be appreciated that the instant specification and claims are set forth by way of illustration and not limitation, and that various modifications and changes may be made without departing from the spirit and scope of the present invention.

What is claimed is:

1. In a dimmer circuit for a high intensity discharge lamp, having an autotransformer receptive of line voltage, a power factor correction capacitor disposed across the output of the auto transformer, a reactor ballast in series with the lamp to be dimmed and a solid state phase control circuit connected in series with a lamp to be dimmed, the improvement comprising means for maintaining a lamp arc in the lamp to be dimmed including a high frequency bypass capacitor disposed in parallel with the lamp to be dimmed, a high frequency coupling transformer in series with the lamp to be dimmed and means for applying high frequency power to the input of the high frequency coupling transformer.

* * * * *